US007077155B2

(12) United States Patent
Giammaria

(10) Patent No.: US 7,077,155 B2
(45) Date of Patent: Jul. 18, 2006

(54) HOT WATER RECIRCULATING SYSTEM

(76) Inventor: Bruno Giammaria, 1769 Prince of Whales Dr, Ottawa, Ontario (CA), K2C 1P2

( * ) Notice: Subject to any disclaimer, the term of this patent is extended or adjusted under 35 U.S.C. 154(b) by 214 days.

(21) Appl. No.: 10/820,043

(22) Filed: Apr. 8, 2004

(65) Prior Publication Data

US 2004/0200532 A1 Oct. 14, 2004

(30) Foreign Application Priority Data

Apr. 11, 2003 (CA) ..... 2425237

(51) Int. Cl.
*F16K 49/00* (2006.01)

(52) U.S. Cl. ..... 137/337; 137/563; 126/362; 417/12; 417/32

(58) Field of Classification Search ..... 137/337, 137/563; 126/362; 417/32, 12
See application file for complete search history.

(56) References Cited

U.S. PATENT DOCUMENTS 1,780,379 A * 11/1930 Durdin, Jr. ..... 122/13.3
3,096,021 A 7/1963 Lintvedt
4,142,515 A * 3/1979 Skaats ..... 122/13.3
4,321,943 A 3/1982 Haws
5,009,572 A 4/1991 Imhoff et al.
5,042,524 A 8/1991 Lund
5,143,049 A 9/1992 Laing et al.
5,277,219 A 1/1994 Lund
5,829,475 A * 11/1998 Acker ..... 137/337

FOREIGN PATENT DOCUMENTS

| | | |
|---|---|---|
| CA | 2067938 | 11/1992 |
| CA | 2162206 | 5/1997 |
| CA | 2174069 | 6/1997 |
| CA | 2249983 | 1/2005 |

* cited by examiner

*Primary Examiner*—A. Michael Chambers
(74) *Attorney, Agent, or Firm*—Shapiro Cohen

(57) ABSTRACT

A hot water circulating system to provide instant hot water including a hot water source connected to one or more fixtures and a hot water return line from the fixture to the hot water source including a check valve and a continuous circulation pump in the return line.

5 Claims, 2 Drawing Sheets

17

12

HOT WATER RECIRCULATING SYSTEM

This invention relates to domestic hot water systems and more particularly a hot water recirculation system. The use of existing hot water systems causes millions of litres of drinking water to go down drains daily while people are waiting for hot water to get to the tap. This new system will provide hot water almost immediately, saving water, time, energy and the environment.

As described in U.S. Pat. Nos. 5,042,524, 5,143,049 and 5,277,219 a considerable amount of water and thermal energy is wastefully dissipated from hot water lines connected to fixtures such as wash basins and showers if water is allowed to go to the drain while waiting for hot water to be delivered. The provision of a hot water return lines, check valves and a continuous circulating pump of this invention is not found in these patents.

SUMMARY OF THE INVENTION

A hot water on demand system in accordance with this invention generally includes a hot water heater connected to a water supply line, a first hot water line connected to the hot water heater and one or more plumbing fixtures. The first hot water line provides for circulation of hot water from the hot water heater to the plumbing fixtures. A second line is connected to the first hot water line by a T adjacent each of the plumbing fixtures and to an inlet of the hot water heater. Pump means is provided for circulating hot water, in the first line adjacent the plumbing fixtures to return to the inlet of the heater.

A thermometer is provided adjacent the hot water heater check valves are also provided in the hot water return line and the cold water supply line.

- a hot water heater having an inlet and an outlet port;
- a hot water line coupled to the outlet port of the hot water heater and at least one plumbing fixture for circulating hot water from the hot water heater to each plumbing fixture;
- a cold water line coupled to each plumbing fixture for circulating cold water to each plumbing fixture;
- a hot water return line coupled to the hot water line adjacent each plumbing fixture and to an inlet of the hot water heater;
- a first check valve coupled to the hot water return line and the cold water line for regulating flow from the cold water line to the inlet port and for preventing hot water entering the cold water line;
- a second check valve coupled to the hot water return line between the inlet port and each plumbing fixture for preventing pressure reduction in the hot water return line below a predetermined level and thereby preventing cold water from entering the hot water return line;
- a pump means coupled to the hot water return line for circulating hot water from each fixture to the inlet port of the hot water heater.

DETAILED DESCRIPTION OF THE DRAWINGS

Figure 1:
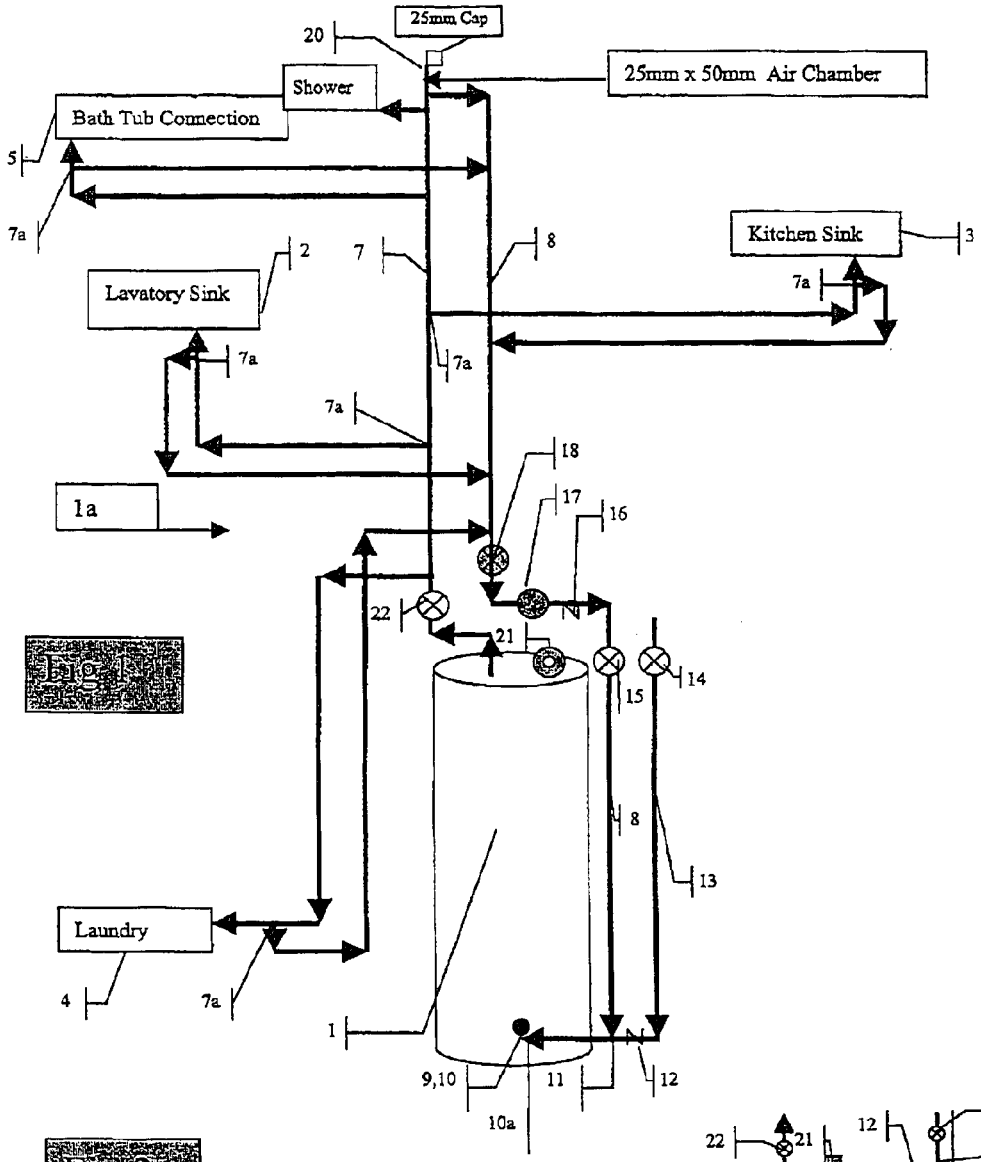
FIG. 1 illustrates a hot water system.

Referring now in detail to the drawings FIG. 1 shows a hot water circulating system indicated generally by the numeral 1*a* the system 1*a* includes a water heater 1 connected to plumbing fixtures including a lavatory sink 2, a kitchen sink 3, a laundry tub 4 and a bath tub 5 by hot water lines 7. Suitable T fittings 7*a* provided on the hot water lines 7 adjacent each of the plumbing fixtures 2, 3, 4, and 5 connect the hot water return line 8 to the hot water lines 7.

The hot water return line 8 is connected at its other end to the intake 9 of the water heater 1. A modified connector 10*a* is provided including the existing drain valve 10.

A T connection 11 is provided in place of the drain valve 10*a* and the original drain valve 10*a* is reinstalled together with the cold water line 13.

Figure 2:
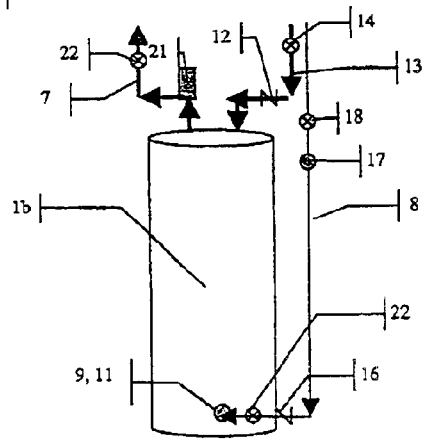
FIG. 2 illustrates a hot water system for a different hot water tank.
Figure 3:
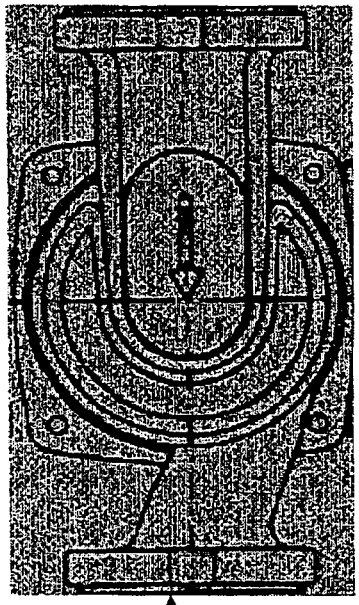
FIG. 3 is a sectional view of a circulation pump for use with the system.
Figure 4:
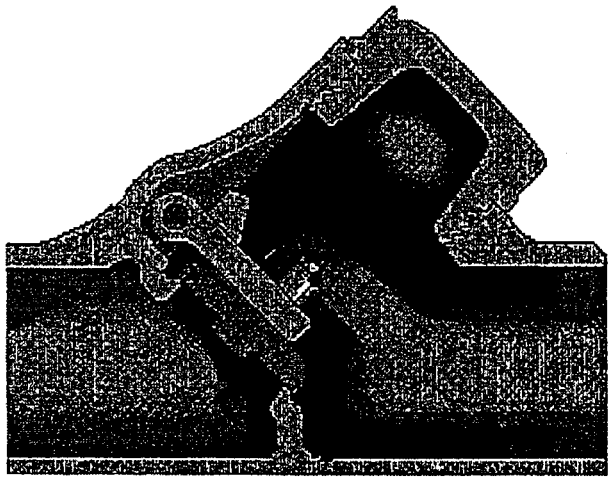
FIG. 4 is a sectional view of a check valve for use in the hot water system.

In FIG. 2 a different hot water tank is shown at 1*b* wherein the hot water line 7 and the cold water line 13 are connected to the top of the tank 1*b*. The hot water return line 8 is connected to a fitting provided at a lower portion of the hot water tank 1*b*. A ball type shut off valve 22 and a check valve 16 are provided in the line 8 adjacent the tank 1*b*. A circulatory pump 17 is provided in the return line 8 and a thermometer 21 allows reading of the temperature of the water in the hot water tank 1*b* and hot water system 1*a*.

The four ball valves 14, 15, 18, 22 installed on the hot water return line 8 and on hot water feed line 7 and on cold water feed line 13 allow the hot water system 1*a* to be completely isolated from the conventional hot water system. When replacement or maintenance of the hot water tank 1 or the circulating pump 17 is required the valves 14, 15, 18, 22 can be closed, resulting in easy maintenance, as the whole water system does not have to be drained. The valves 14, 15, 18, 22 give full flow once in position and are almost the same size as the inside diameter of the pipe that being used. Check valve 12 serves to prevent hot water back flow into the cold water lines 13 when the hot water is not being drawn at any tap or in use. An air chamber 20 is also provided on the hot water line 7.

The check valve 12 or 16, which are preferably between 13 mm to 20 mm in diameter, prevent cold water from entering the connection at the bottom of the hot water tank 1 or 1*b* when hot water taps are in use because it creates negative pressure in the hot water return line.

Insulating hot water lines 7, hot water return lines 8, air chambers 20, pump body and motor 17 and mixing valve bodies is recommended to prevent heat loss, banging noises and cracking noises.

Thermometers 21 may be provided to monitor the water temperature in the hot water tank, 1 or 1*b* the lines 7.

What is claimed is:

1. A hot water on demand system for a household comprising:

- a hot water heater having an inlet and an outlet port;
- a hot water line coupled to the outlet port of the hot water heater and at least one plumbing fixture for circulating hot water from the hot water heater to each plumbing fixture;
- a cold water line coupled to each plumbing fixture for circulating cold water to each plumbing fixture;
- a hot water return line coupled to the hot water line adjacent each plumbing fixture and to an inlet of the hot water heater;
- a first check valve coupled to the hot water return line and the cold water line for regulating flow from the cold water line to the inlet port and for preventing hot water entering the cold water line;

a second check valve coupled to the hot water return line between the inlet port and each plumbing fixture for preventing pressure reduction in the hot water return line below a predetermined level and thereby preventing cold water from entering the hot water return line;

a pump means coupled to the hot water return line for circulating hot water from each fixture to the inlet port of the hot water heater.

2. The hot water system according to claim 1, wherein the hot water line and the hot water return line are insulated to prevent heat loss.

3. The hot water system according to claim 1, further comprising at least one shut off valve couple to each of the hot water line, the hot water return line and the cold water line for restricting the flow of hot and cold water to and from the hot water heater, thereby rendering the hot water heater easily removable.

4. The hot water system according to claim 1, wherein the hot water heater has a thermometer for measuring the temperature of the water in the hot water line.

5. The hot water system according to claim 1, wherein the first and the second check valves each have a diameter of between 13 mm and 20 mm.

* * * * *